United States Patent [19]

Muzak

[11] 4,439,991

[45] Apr. 3, 1984

[54] METHOD AND APPARATUS FOR TREATING ELONGATE MATERIALS

[75] Inventor: Nicholas Muzak, Hamilton, Canada

[73] Assignee: Stelco Inc., Hamilton, Canada

[21] Appl. No.: 387,421

[22] Filed: Jun. 11, 1982

[51] Int. Cl.[3] ..... F25D 13/06; F25D 17/02; F25B 19/00

[52] U.S. Cl. ..... 62/63; 62/100; 62/374

[58] Field of Search ..... 118/50, 419, 420; 427/294, 295, 356, 350, 358, 378, 398.4; 34/16, 20, 23, 92, 152, 218; 62/63, 64, 100, 374

[56] References Cited

U.S. PATENT DOCUMENTS

| | | | |
|---|---|---|---|
| 3,128,606 | 4/1964 | Watson | 62/100 |
| 3,480,469 | 11/1969 | Shaffer | 427/350 X |
| 3,693,352 | 9/1972 | Hinze et al. | 62/64 |
| 4,110,092 | 8/1978 | Kunioka et al. | 62/64 |
| 4,231,164 | 11/1980 | Barbee | 34/92 |
| 4,287,238 | 9/1981 | Stauros | 118/420 X |

FOREIGN PATENT DOCUMENTS

| | | | |
|---|---|---|---|
| 2317631 | 10/1974 | Fed. Rep. of Germany | 427/350 |

*Primary Examiner*—Michael R. Lusignan
*Attorney, Agent, or Firm*—Sim & McBurney

[57] ABSTRACT

There is provided a method and apparatus for cooling elongate product, such as wire. A housing is provided to define a chamber with an inlet for the product and an outlet for the product, both the inlet and outlet being larger in area than the product. Within the chamber liquid is sprayed against the product to cool it, and suction is utilized to withdraw air and liquid from the chamber at a rate which results in an air-wiping effect on the product by the air entering the chamber through the inlet and outlet.

13 Claims, 8 Drawing Figures

METHOD AND APPARATUS FOR TREATING ELONGATE MATERIALS

This invention relates generally to the treatment of materials in continuous form, such as drawn wire, and is particularly applicable to a method and apparatus for allowing drawn high-carbon wire to be cooled between drawing passes.

BACKGROUND OF THIS INVENTION

Excessive heat during draawing of high carbon wire causes high wire temperature that reduces ductility. When wire temperatures remain above 375° F. for more than several seconds, strain ageing embrittles the wire, increasing its tensile strength but reducing torsional and other ductility. Therefore, wire temperature should be kept as low as possible.

The following factors affect the generation of drawing heat:

drawing speed;

pass area reduction; and friction in the die.

Reducing the drawing speed reduces drawing heat, and therefore reduces wire temperature, but is uneconomical because of the loss of productivity.

Decreasing the area of reduction at each draft is also uneconomical since more drafts are required which necessitates a larger machine.

Lubricants are used to reduce die friction. However, high temperatures cause lubricant breakdown which can lead to poor wire quality (as a result of surface scratching), wire breakage, and reduced die life.

Historically, the heat introduced into the wire has been removed by water-cooled capstans assisted by forced air. This method of cooling has reached its limit of effectiveness and the industry has progressed to directly contacting the wire with coolant. Direct wire cooling has enabled operators either to increase drawing speeds while maintaining wire quality, or to produce superior quality wire at existing speeds.

Canadian Pat. No. 1,006,119, issued Mar. 1, 1977 to Kobe Steel, Ltd., attempted to increase drawing speeds without increasing drawing heat by providing a water-cooled drawing die. Water flows around the die, and then through a tube attached to the die. The water in the tube area directly contacts the wire. This apparatus allows increased speeds without affecting wire quality but has the following disadvantages:

the wire must be provided with a long tapered point during threading, since the apparatus is not removeable for string-up;

existing die holders and soap boxes must be modified;

if the wire breaks in the die, water will get into the soap box causing lubricant break-down;

residual cooling water is removed from the wire surface by an air wipe which can be noisy; and cooling water chills the hot die and can cause die cracking.

Canadian Pat. No. 1,044,181, issued Dec. 12, 1978 to G. K. N. Somerset Wire Limited, attempts to maintain high carbon wire at low temperature (to control strain ageing) by spraying high pressure water directly onto the wire as it passes from the drawing die to the capstan. The apparatus described has several disadvantages:

the water spray is not contained and as a result humidity is increased which can lead to product rusting;

the high pressure air used to wipe the sprayed product creates an unacceptably high level of noise; and the cooling device rests, or rides, on the wire being processed, causing wear.

Accordingly, a primary aspect of this invention is to develop a satisfactory and improved technique for using water-spraying to cool drawn wire.

More particularly, it is known that temperatures out of a typical die are about 450° F. for prestressed concrete (PC) strand wire drawn at high speeds. The wire should be cooled to below 350° F. as quickly as possible, and it has been found that spraying water on a single wire before it reaches the block is one way to accomplish such cooling.

Generally speaking the criteria for satisfactory performance of a cooling device as envisioned herein are as follows:

fast cooling (i.e. 450° F. to 350° F. in 0.5 sec);

device must contain all steam, spray, and water (i.e. no leakage);

wire must be dry when it leaves the device;

device must fit in the available space between the die box and block;

must be movable to allow normal string-up;

must not generate excessive noise; and must be suitable for various wire sizes.

In order to obtain fast cooling the method and apparatus of this invention, as applied to the cooling of drawn wire, proposes to spray the wire with water.

In regard to containment, it is important that all steam generated, all overspray and water, must be contained in the cooling device. Leakage to the atmosphere should be minimized because if the air around the soap boxes becomes too moist, the soap lubricant absorbs water and will not perform properly. Containment is achieved, in accordance with the present method and apparatus, by drawing a vacuum on the cooling device.

With respect to the drying of the wire, it is proposed that all moisture be removed from the surface of the wire by air wiping. The exit from the spray box is sized such that when the proper air flow is drawn by the vacuum system, a high velocity air wipe is created. Any residual dampness on the wire will evaporate quickly since the wire temperature is well above the boiling point of water.

The cooling device of this invention can be made compact and rugged, in order to fit the space between the die box and the block. The wire does not have to pass through the geometric center of the device for water sprays to cool it effectively. The length of the device can be adjusted to fit the available space. If the device must be shorter than optimum, a greater water flow can be used to increase the cooling. The cooling device is preferably loosely held in place so that it can "float" with the moving wire and be aligned by it.

In order to allow the cooling device to be removed to allow string-up, the device is split longitudinally and hinged on one side so that it can be opened and placed around a wire already strung up. Inserts at both ends are also split. The device is connected by flexible hoses to the water supply and the vacuum pump.

With respect to noise generation, it is known that high pressure air wipes usually generate noise at levels requiring ear protection, because the air is exhausted to the atmosphere. However with the present device, the cooling noise cannot be heard above the ambient noise because a low pressure vacuum is used, and because the air wipe exhausts into the device.

By utilizing hardened inserts at the ends of the cooling device, constituting wear guides and air wipe orifices, the device can be adapted to various wire sizes. The outside diameter of the inserts is standardized so that the inserts are interchangeable. The inside diameters are sized for various wire gauges.

It should be pointed out that the principle of this invention could be utilized to carry out operations other than cooling. For example, the treatment of a drawn wire or extruded product with a liquid could be carried out separately or at the same time as the cooling.

Accordingly, this invention provides a method for treating wire, the method comprising several steps:

First, a housing is provided to define a chamber having an inlet for the wire and an outlet for the wire. Both the inlet and the outlet are larger in area than the maximum cross-sectional area of the product. The wire is passed through the chamber from the inlet to the outlet, while liquid is sprayed against the wire. Simultaneously, suction means is caused to withdraw air and liquid from the chamber at a rate which results in an air-wiping effect on the wire due to the entry of ambient air through the inlet and outlet of the chamber.

Additionally, this invention provides an apparatus for treating wire, the apparatus including a housing defining a chamber having an inlet for the wire and an outlet for the product, both the inlet and the outlet being larger in area than the maximum cross-sectional area of the wire. Nozzle means are provided within the chamber for spraying liquid against the wire. Additionally, supply means are provided for supplying liquid under pressure to the nozzle means, and suction means communicate with the chamber for withdrawing air and liquid from the chamber at a rate which results in an air-wiping effect on the wire due to the ambient air entering the chamber through the inlet and outlet.

GENERAL DESCRIPTION OF THE DRAWINGS

Two embodiments of this invention are illustrated in the accompanying drawings, in which like numerals denote like parts throughout the several views, and in which.

Figure 1:
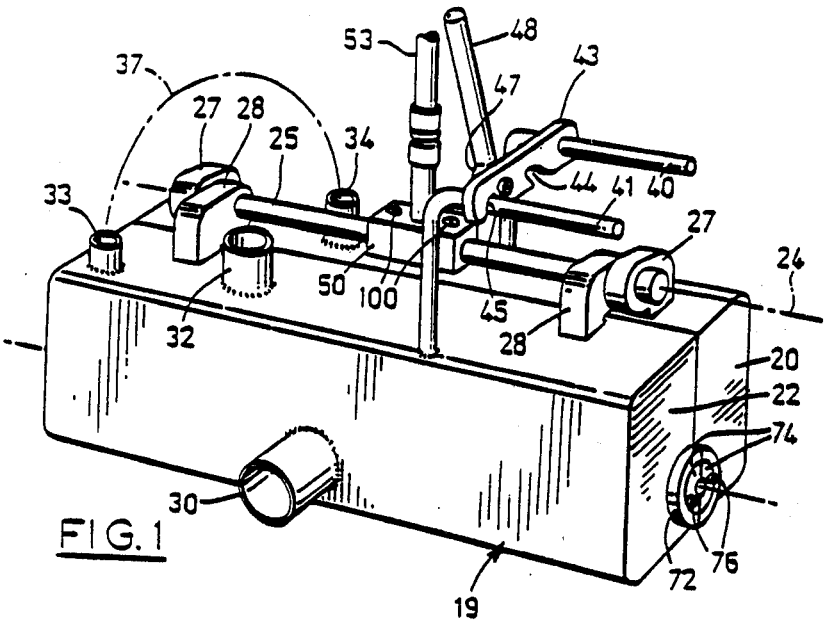
FIG. 1 is a perspective view of the first embodiment of a device constructed in accordance with this invention.
Figure 2:
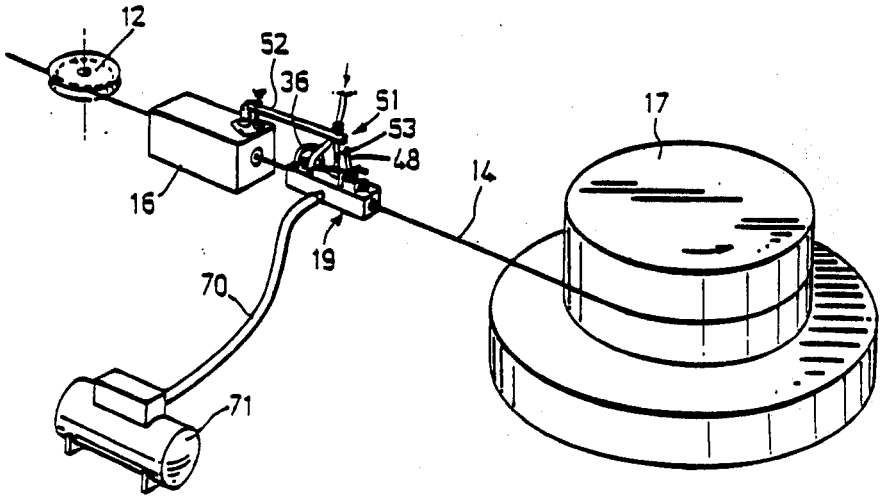
FIG. 2 is a somewhat schematic view, to a smaller scale, of a wire drawing installation in which the device of FIG. 1 is employed.
Figures 2A, 3:
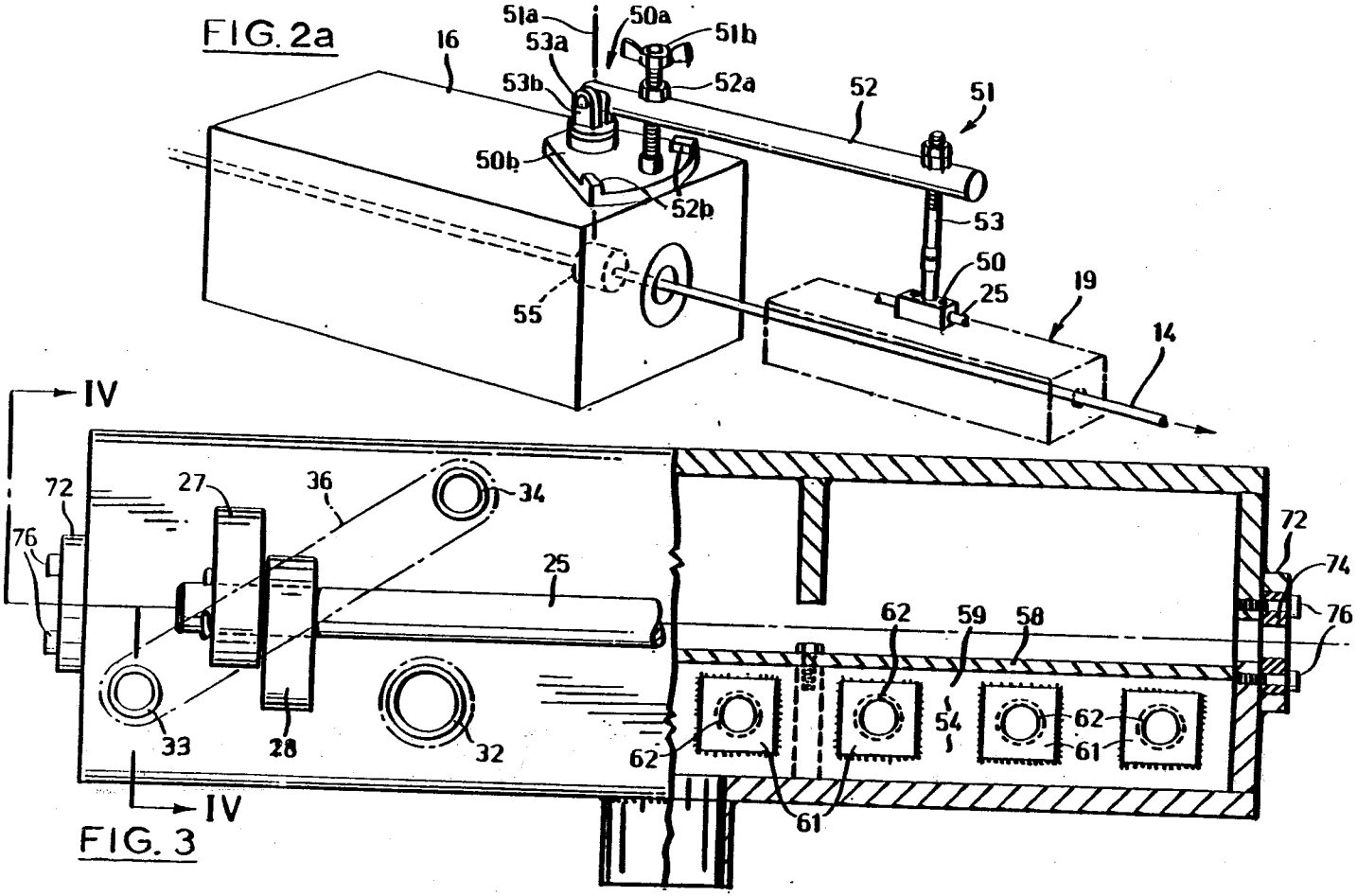
Figure 5:
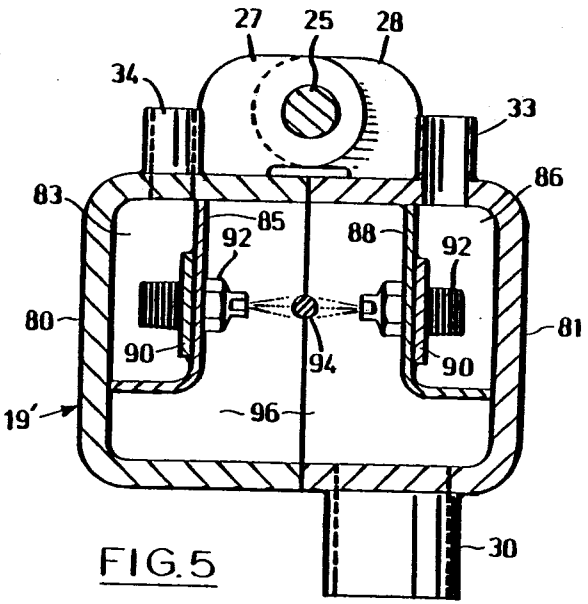
Figure 4:
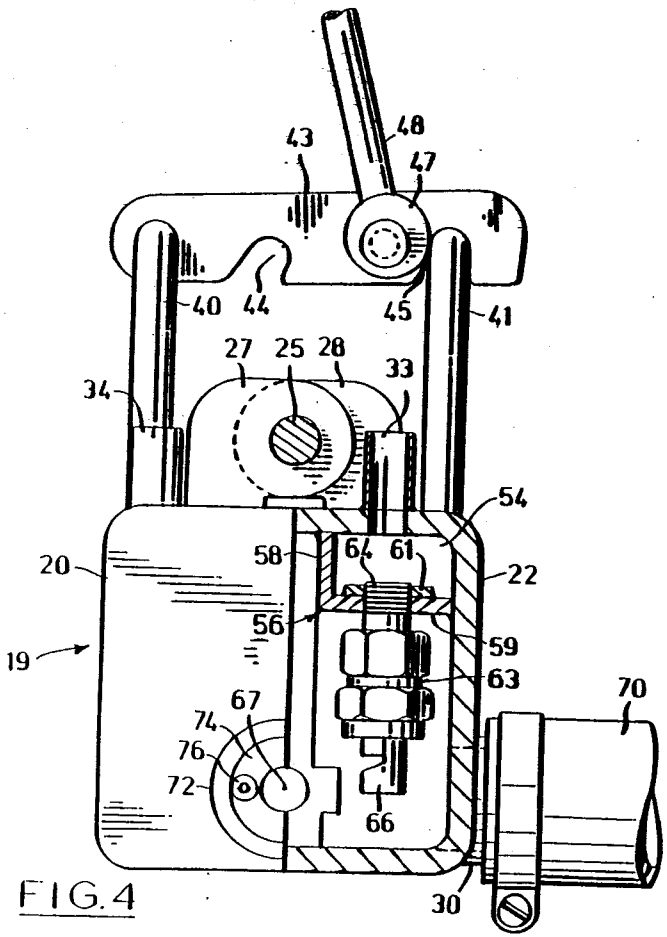
Figure 6:
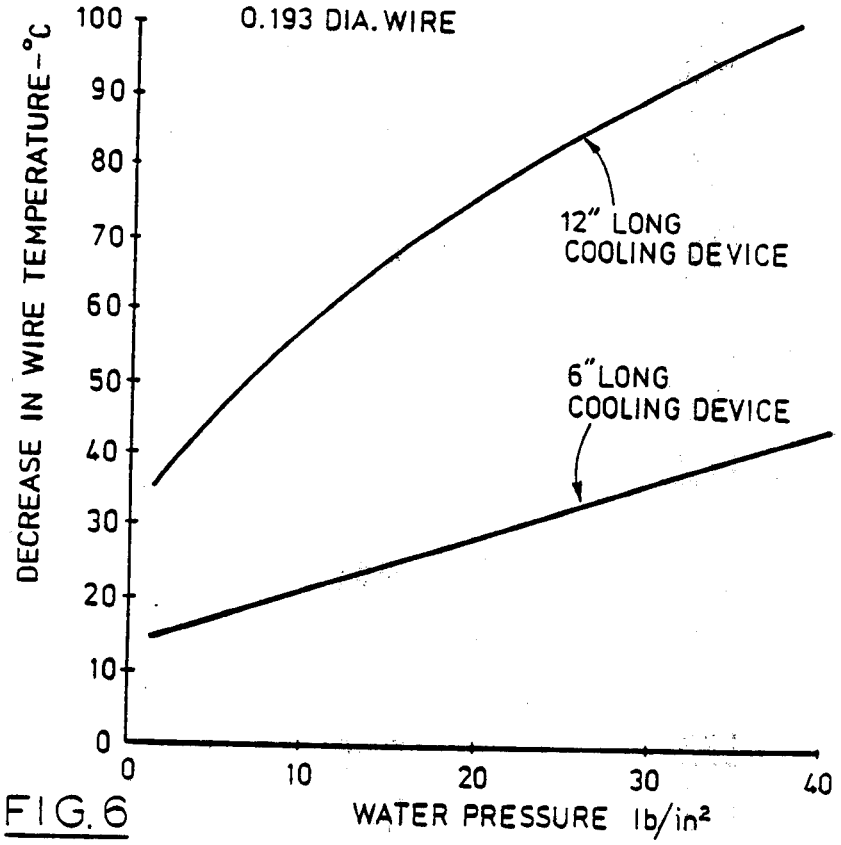

FIG. 2*a* is a perspective view of a support arm assembly;

FIG. 3 is a part plan and part section of the first embodiment of the device of FIG. 1;

FIG. 4 is a part end view, part section, taken along the line IV—IV in FIG. 3;

FIG. 5 is a sectional view of the second embodiment of this invention;

FIG. 6 is a graph of cooling performance, and

Figure 7:
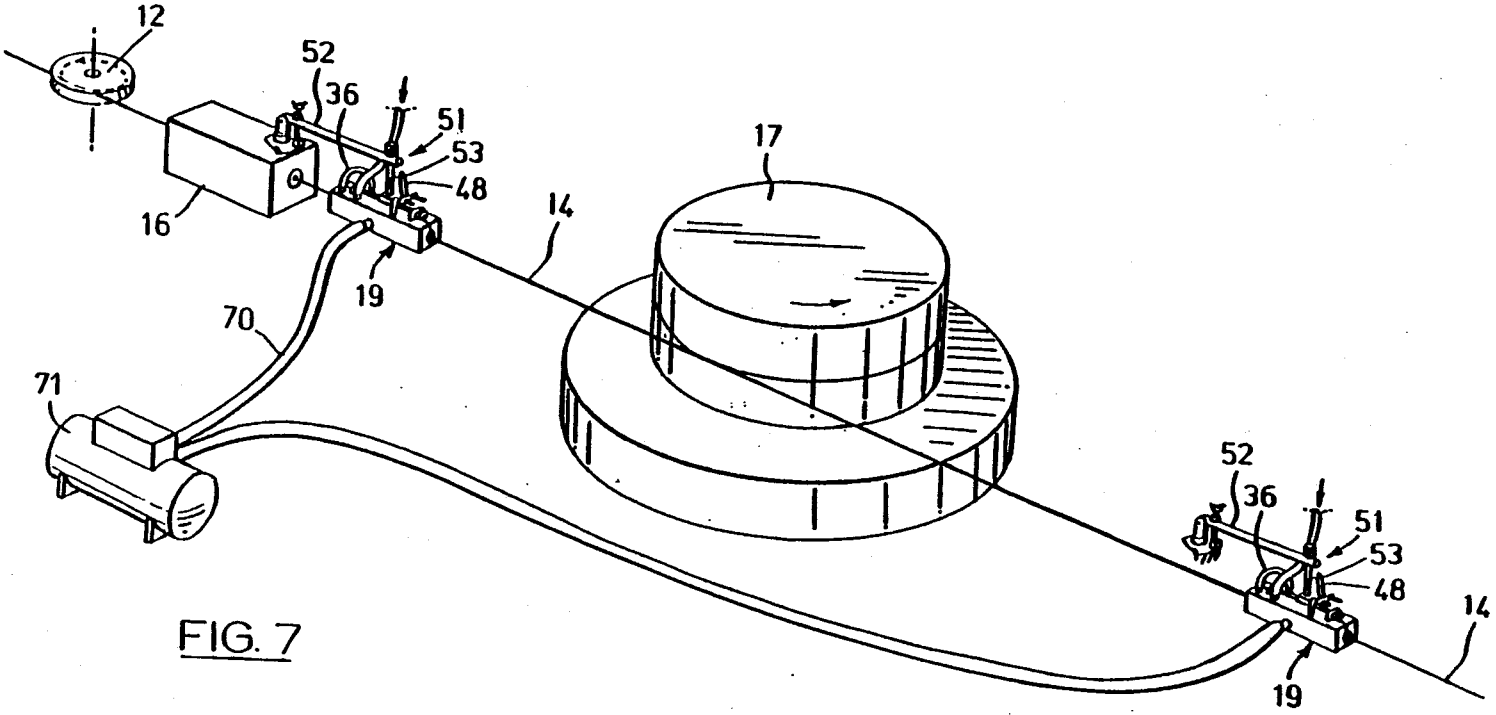

FIG. 7 is a schematic plan view of a wire-drawing installation employing a two-stage cleaning process.

DETAILED DESCRIPTION OF THE DRAWINGS

Attention is first directed to FIG. 2, which shows a guide sheave 12 around which a wire 14 is strung. From the sheave 12, the wire 14 passes into and through a die box 16, and then proceeds to the block 17 on which it is wound. Between the die box 16 and the block 17 is located a cooling device 19 which is shown to a larger scale in FIG. 1.

The device 19 consists of two halves 20 and 22, hinged together along an axis 24 defined by the center of a hinge pin 25. The half 20 of the device 19 has affixed to it two spaced apart hinge knuckles 27, while the nearer half 22 has affixed to it two further hinge knuckles 28. The hinge knuckles 27 and 28 cooperate in pairs to allow the two halves 20 and 22 of the device 19 to articulate about the axis identified by the numeral 24.

Essentially, the cooling device 19 contains two sets of spray nozzles adapted to direct spray at a wire passing through the device in the longitudinal direction, both the wire and the nozzles being located in a chamber which can be connected to a vacuum line through a port 30.

Water is admitted to the device 19 through a water inlet pipe 32 which communicates with a plenum (shortly to be described with reference to the other drawings) communicating with one set of nozzles, i.e. those in the half 22 of the device 19. A further pipe 33 is in communication with the same plenum as pipe 32, and a third pipe 34 is in communication with a plenum which is connected with the other set of nozzles in the half 20 of the device 19. The two pipes 33 and 34 are intended to be connected by a flexible hose 36 (see FIG. 2), following the broken line 37 in FIG. 1. It is necessary to provide such a flexible hose, in order to allow the two halves 20 and 22 to hinge about the line 24.

The two halves 20 and 22 are provided with means which is adapted to lock the halves in the closed position, i.e. the position shown in FIG. 1. This means includes two right angle bars 40 and 41, welded or otherwise securely affixed to each of the halves 20 and 22 as shown in FIG. 1. The bars 40 and 41 have parallel portions extending in longitudinal alignment with the long direction of the device 19. Pivotally connected to this aligned portion of the bar 40 is a latch 43, having two notches 44 and 45. In FIG. 1, the bar 41 is lodged in the notch 45.

Pivoted to the latch 43 adjacent the notch 45 is a locking cam 47 to which a control bar 48 is affixed. This is best shown in FIG. 4. The locking cam 47 is intended to lock the latch 43 with respect to the bar 41, by suitably setting the control bar 48. Latch, locking and clamping mechanism construction is a matter of design choice.

Mounted on the hinge pin 25 is a freely pivotal block 50, which is used to generally support the device 19. The weight of the device 19 is intended to be carried by a support assembly 51 which includes support arm members 52 and 53, the latter being partly shown in FIG. 1. The support assembly 51 maintains the device 19 at approximately the position shown in FIG. 2. In FIG. 1 Allen screws 100 fix pivotal blocks 50 to hinge pin 25 after the desired position of device 19 relative to die box 16 has been determined.

The support assembly 51 shown in FIG. 2A carries the weight of the cooling device 19. When properly adjusted, the support arm members 51 and 53 hold the cooling device 19 in position and prevent it from resting on the wire 14. The support assembly 51 includes a swivel assembly 50*a* that allows motion in the lateral direction. The swivel assembly 50*a* is fastened to a swivel mounting bracket 50*b* which in turn is mounted to the die box 16. The swivel axis 51*a* is located in vertical alignment with the wire drawing die throat (shown in broken line at 55), which is the bending point for the wire exiting the die. The wire generally follows a straight path from this point to its contact point on the block 17.

The vertical height of the cooling device 19 is adjusted by means of a height adjusting screw 51*b*. After proper adjustment by the operator, i.e. so that the cooling device 19 is not touching the wire 14, the height adjusting screw 51*b* is locked in position by the locknut 52*a*. Lateral movement of the support arm 52 and adjusting screw is limited by stops 52*b* on the mounting bracket 50*b*. The support arm 52 also pivots vertically about a pin 53*a* in the clevis 53*b* of the swivel assembly 50*a*.

The support assembly allows freedom of movement so that the cooling device 19 can be moved away from the die exit to allow normal string up of the wire. In FIG. 2A the complete arm arrangement is shown.

Attention is now directed to FIGS. 3 and 4, for a description of the internal components of the device 19.

On the righthand side of FIG. 4, a sectional view of the half 22 is illustrated. The pipe 33 (as also the pipe 32, not illustrated in FIG. 4) communicates through the wall of the half 22 with a plenum 54, defined in part by the wall portion of the half 22, and in part by an L-shaped partition 56 having an upstanding wall 58 and a horizontal wall 59. A plurality of square block portions 61 are welded at intervals to the horizontal wall 59, and through both of these an internally threaded hole 62 is positioned. This hole would normally be provided with a tapering pipe thread so that each hole could snugly receive a nozzle unit 63, as illustrated in FIG. 4. The nozzle unit 63 is a standard item commercially available, and need not be described beyond saying that it has an upper entry end 64 in the configuration shown in FIG. 4, and a spray nozzle 66 at the lower end. In FIG. 4, the spray nozzle 66 is positioned so that the spray can impinge directly against a wire passing through the device along a centerline identified by the numeral 67.

The other half 20 of the device 19 is constructed in the identical manner, and thereafore need not be shown in the figures.

In FIG. 2, the numeral 71 designates a vacuum pump and tank, from which a vacuum hose 70 extends to its connection with the port 30.

In FIG. 1, a fitting 72 is provided at both ends, which is circular in general shape, and which is adapted to receive a hardened wire guide 74. The wire guide 74 is also split into two halves, along the same plane as the rest of the device 19, and the two halves of the wire guide 74 are maintained in place by threaded fasteners 76.

Attention is now directed to FIG. 5, for a description of the second embodiment of this invention.

In FIG. 5, the parts which are the same as equivalent parts in FIG. 4 bear the same numbers. The device 19' includes substantially identical halves 80 and 81, each being C-shaped in section, and defining between them an internal space which is divided into three chambers. A first chamber 83 is defined by the C-shaped half 80 and an L-shaped internal wall 85, while a second chamber 86 is defined between the C-shaped half 81 and an L-shaped internal wall 88. The pipe 33 communicates with the second chamber 86, while the pipe 34 communicates with the first chamber 83.

The walls 85 and 88 are welded to the halves 80 and 81, respectively, and each wall 85, 88 has welded to it, within the respective chamber it defines, a plurality of rectangular blocks 90. Internally pipe-threaded bores are provided through the upstanding portions of the walls 85 and 88 at each of the blocks 90, and into these threaded bores are securely screwed a plurality of V-jet nozzles 92. The numeral 94 identifies the location of a typical wire passing through the third chamber 96, defined between the halves 80 and 81 but exclusive of the first and second chambers 83 and 86.

The vacuum take-off port 30 opens downwardly through the bottom of the right-hand half 81, rather than rightwardly as seen in the embodiment of FIG. 4.

It will be appreciated that, in the embodiment of FIG. 5, the location of the hardened wire guides 74 at either end of the device 19' would be raised as compared with the position shown in the embodiment of FIG. 4.

COOLING PERFORMANCE

The cooling performance achieved in the production trials with the cooling device constructed in accordance with what has been disclosed above is illustrated in FIG. 6. This cooling performance was achieved on a 0.85 carbon, 0.193 in. diameter steel wire drawn at various speeds from 425 ft/min to 650 ft/min. Cooling devices of two lengths have been developed and used in production. If cooling performance is adequate the short device is preferred for retrofitting on existing wire drawing machines. Drawing speeds were increased 53% from 425 ft/min to 650 ft/min (maximum machine speed) while maintaining the required physical properties of the wire.

WIRE WIPING PERFORMANCE

The vacuum drawn on the cooling device has two purposes:

1. contain all water, overspray, steam and moisture inside the device;
2. draw in sufficient air through the inserts to wipe the wire dry.

In connection with the cooling of drawn wire, effective containment and wire wiping are achieved when a vacuum between about 5 in of mercury and 15 in of mercury is maintained on the device. For the described cooling device, under vacuum an air flow through the device of approximately 25 standard $ft^3$/min results. Orifices 25 percent larger than the wire diameter provide sufficient air velocity counterflow to the wire for satisfactory containment and wiping.

Air wipe orifices up to 50 percent larger than the wire diameter have performed satisfactorily.

The air wipe orifices (inserts) are made of high carbon steel. The bore is case hardened to increase wear resistance and is polished to a smooth finish so that scratching of the wire will not occur if the wire touches the insert. The inserts must be replaced when a large change in wire size through the device is made.

In operation the air wipe cannot be heard above the ambient machine noise because of (1) the low pressure (2) the air flows into a closed space which along with the water sprays muffles the sound of the air wipe. The vacuum on the device also sucks in loose soap dust in the air close to the device. The decrease in ambient soap dust is noticeable. Loose soap dust is removed from the surface of the wire as well. This also contributes to reduced ambient dust in the vicinity of the wire drawing machine.

LUBRICANT REMOVAL PERFORMANCE

Direct water cooling of wire removes some of the residual lubricant film when water soluble rod coatings and lubricants are used. Insoluble lubricants can be used to minimize lubricant removal when utilizing direct water cooling, for example phosphate, or lime rod coatings and calcium based drawing lubricants.

In applications where clean wire is required the lubricant removal capabilities of the cooling device can be exploited.

Up to 50% of the residual lubricant film is removed by the cooling device when a water soluble borax rod coating and sodium based wire drawing lubricant combination are sprayed at 30 lb/in.

Experience has shown that, when a wire with a soluble residual film is passed through two 12 in long cooling devices in tandem, 95% of the residual film was removed.

A two-stage cleaning process for drawn wire is shown schematically in FIG. 7.

For the cleaning process the device could be made as long as necessary, providing space were available. Water pressure could be increased to enhance cleaning.

I claim:

1. A method for treating wire, comprising the steps:

(a) providing a housing defining a chamber having an inlet for the wire and an outlet for the wire, both the inlet and the outlet being larger in are a than the maximum cross-sectional area of the wire, (b) passing the wire through the chamber from the inlet to the outlet, (c) within said chamber spraying liquid against the wire, and (d) using suction means to withdraw air and liquid from said chamber at a rate which results in an air-wiping effect on the wire due to the entry of ambient air through the inlet and outlet of said chamber.

2. The method claimed in claim 1, in which the wire is drawn wire and is cooled within the chamber.

3. The method claimed in claim 1, in which the liquid is water.

4. The method claimed in claim 1, claim 2 or claim 3, in which the said suction means includes a vacuum pump.

5. The method claimed in claim 1, claim 2 or claim 3 in which said suction means includes a vacuum pump, and in which the vacuum applied to the chamber is between about 5 inches and about 15 inches of mercury.

6. The method claimed in claim 3, in which the quantity and speed of the water spray is such as to leave the wire at a temperature above the boiling point of water upon exit of the wire from the chamber, whereby any excess dampness on the wire will evaporate into the ambience.

7. The method claimed in claim 6, in which said suction means includes a vacuum pump, and in which the vacuum applied to the chamber is between about 5 inches and about 15 inches of mercury.

8. An apparatus for treating wire, comprising:

(a) a housing defining a chamber having an inlet for the wire and an outlet for the wire, both the inlet and the outlet being larger in area than the cross-sectional area of the wire, (b) nozzle means within the chamber for spraying liquid against the wire, (c) supply means for supplying liquid under pressure to said nozzle means, and (d) suction means communicating with the chamber for withdrawing air and liquid from the chamber at a rate which results in an air-wiping effect on the wire due to ambient air entering said chamber through the inlet and outlet.

9. The apparatus claimed in claim 8, in which the inlet and outlet are defined by substantially circular openings in the housing at opposite ends of said chamber.

10. The apparatus claimed in claim 8, in which said suction means includes a vacuum pump capable of applying to the chamber a vacuum of between about 5 inches and about 15 inches of mercury.

11. The apparatus claimed in claim 8, in which said housing has two halves adapted to mate together along a plane which intercepts both the inlet and the outlet, the two halves being hinged together and having lock means adapted selectively to maintain the two halves in engagement and to allow the two halves to swing apart.

12. The apparatus claimed in claim 11, in which said lock means comprises two right-angle bars extending from and affixed to said two halves respectively, each bar having a first part extending away from its respective housing half, and a second part extending perpendicular to the first part, the two second parts being parallel, a locking link hinged to one of said second parts and having a notch in which the other of said second parts can be received when the two housing halves are closed together, and cam means for retaining said other of said second parts in position within said notch.

13. The apparatus claimed in claim 8, claim 10 or claim 11, in which said supply means includes an elongate plenum within the housing, sealed off from said chamber and extending substantially parallel with the direction in which the product moves through the chamber; and in which said nozzle means includes a plurality of individual nozzles communicating with the interior of the plenum to receive liquid therefrom.

* * * * *